US007377822B1

(12) United States Patent
Shen

(10) Patent No.: US 7,377,822 B1
(45) Date of Patent: May 27, 2008

(54) ELECTRICAL CONNECTOR

(75) Inventor: Chang-Tai Shen, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/638,478

(22) Filed: Dec. 14, 2006

(51) Int. Cl.
*H01R 39/00* (2006.01)

(52) U.S. Cl. ..... 439/700; 439/824

(58) Field of Classification Search ..... 439/700, 439/824, 515

See application file for complete search history.

(56) References Cited

U.S. PATENT DOCUMENTS 1,523,144 A * 1/1925 Snorf ..... 439/551
4,176,905 A * 12/1979 Marechal ..... 439/824
4,743,201 A * 5/1988 Robinson et al. ..... 439/10
5,330,373 A * 7/1994 Terayama ..... 439/700
6,033,233 A * 3/2000 Haseyama et al. ..... 439/66
6,773,312 B2 * 8/2004 Bauer et al. ..... 439/824
6,921,299 B2 * 7/2005 McMaster ..... 439/700
7,048,574 B2 * 5/2006 Shinohara et al. ..... 439/515
2004/0224570 A1 * 11/2004 Yeh ..... 439/824
2004/0266272 A1 * 12/2004 Maruyama et al. ..... 439/700
2006/0166564 A1 * 7/2006 Baranowski ..... 439/700

* cited by examiner

*Primary Examiner*—Gary F. Paumen
(74) *Attorney, Agent, or Firm*—Rosenberg, Klein & Lee

(57) ABSTRACT

An electrical connector includes an insulative housing and a conductive terminal received in the insulative housing. The conductive terminal has a first conductive body and an elastic body elastically abutted against the first conductive body. The conductive terminal further comprises a conductive wire electrically connected between the first conductive body and a mating element. Moreover, the conductive wire ensures the electrical connector works in good condition, and the two mating elements are effectively and electrically connected with each other.

9 Claims, 2 Drawing Sheets

ELECTRICAL CONNECTOR

BACKGROUND OF THE INVENTION

1. Field of the Invention

The present invention relates to an electrical connector, and particularly relates to an electrical connector which ensures two mating elements effectively and electrically connected each other.

2. Description of the Related Art

Because peripheral devices for computers are continually being developed, probe-type electrical connectors are used extensively for the peripheral devices. A conventional electrical connector includes: an insulative housing and a conductive terminal. The insulative housing has a receiving groove formed therein. The conductive terminal is received in the receiving groove. Generally, the conductive terminals have a first conductive body as well as a second conductive body for receiving the first conductive body. The first conductive body can movably connect with the second conductive body. Furthermore, an elastic body is received in the second conductive body for elastically abutting against the first conductive body. When the electrical connector electrically connects to a mating element, the first conductive body is moved downward to a predetermined position. At the same time, the elastic body provides enough elasticity for the first conductive body to ensure that the first conductive body tightly contacting with the mating element. However, vibrations often cause the first conductive body disconnecting from the second conductive body, result in the electrical connector cannot be used normally. In other words, it will lose electrical connection between the electrical connector and the mating element.

SUMMARY OF THE INVENTION

One particular aspect of the present invention is to provide an electrical connector that can work in good condition and sustain for a long time.

In order to achieve the above-mentioned aspects, the present invention provides an electrical connector for connecting mating elements comprising an insulative housing and a conductive terminal received in the insulative housing, wherein the conductive terminal has a first conductive body and an elastic body elastically abutting against the first conductive body. A conductive wire is electrically connected between the first conductive body and the mating element.

In the present embodiment, the conductive wire ensures that the electrical connector works in good condition and the two mating elements effectively and electrically connected with each other.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE PREFERRED EMBODIMENTS

Figure 1:
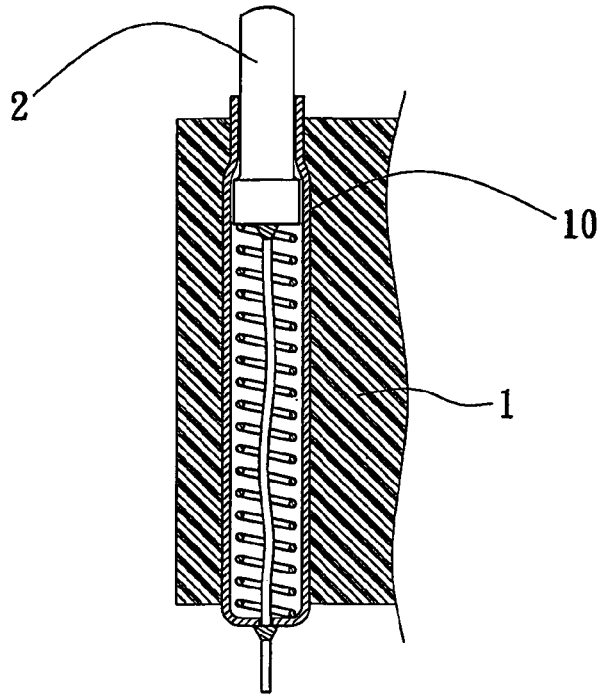
FIG. 1 is a partial cross-sectional view of an electrical connector according to the first embodiment of the present invention.
Figure 2:
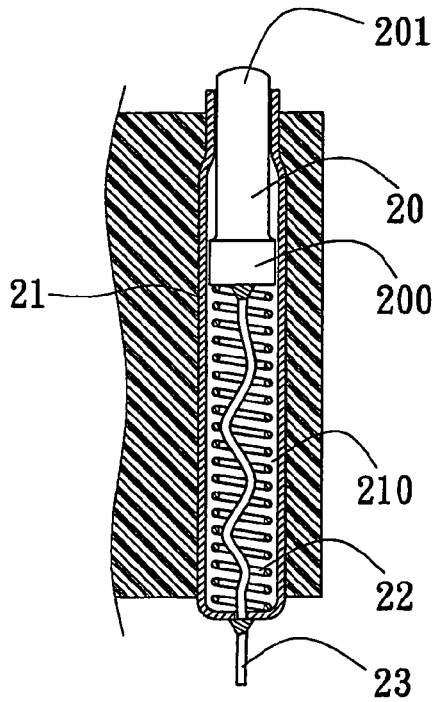
FIG. 2 is a schematic view of an electrical connector (when a first conductive body is pressed downward) according to the first embodiment of the present invention.

Referring to FIGS. 1 and 2, the present invention provides an electrical connector comprising an insulative housing 1 and a conductive terminal 2. The insulative housing 1 is shaped approximately in a rectangular structure (in the first embodiment, one part of the insulative housing is shown). The insulative housing 1 has a plurality of rectangular receiving grooves 10 penetrating therethrough and respectively arranged therein (in the first embodiment, only one receiving groove 10 is shown). The conductive terminal 2 is received in the insulative housing 1, and the conductive terminal 2 can elastically contact with a first mating element (not shown).

The conductive terminal 2 has a first conductive body 20 and a second conductive body 21. The second conductive body 21 has a receiving space 210 for receiving the first conductive body 20 and an elastic body 22 for elastically abutting against the first conductive body 20. The first conductive body 20 is movably connected with the second conductive body 21. The conductive terminal 2 further comprises a conductive wire 23 electrically connected between the first conductive body 20 and a second mating element (the connection method can be soldering or any other connection method). The conductive wire 23 is exposed outside of the insulative housing 1 for electrically connecting the second conductive body 21 so that the first conductive body 20 electrically connects with the second conductive body 21. In the first embodiment, the conductive wire 23 can be a gold wire or any other kinds of metal wire so long as the impedance of the conductive terminal is unchangeable and the electric conductivity of the conductive terminal is stable. The first conductive body 20 has a hook portion 200 retained in the second conductive body 21. One side of the conductive wire 23 is jointed with the hook portion 200. The other side of the conductive wire 23 is jointed with the second mating element for facilitating electrical connection between the first conductive body 20 and the second mating element. The first conductive body 20 also has a contact portion 201 for contacting the first mating element in order to electrically connect the first mating element and the second mating element. When the electrical connector electrically connects to the first mating element, the first conductive body 20 moves downward to a predetermined position. At the same time, the elastic body 22 provides enough elasticity for the first conductive body 20 to ensure that the first conductive body 20 tightly contacts the first mating element. In the present embodiment, the conductive wire 23 ensures the electrical connector works in good condition, and the two mating elements effectively and electrically connected each other.

Figure 3:
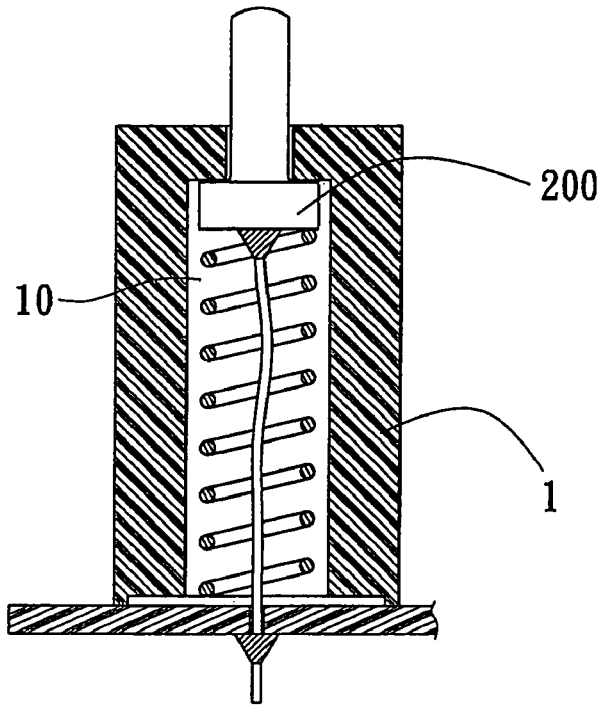
FIG. 3 is a partial cross-sectional view of an electrical connector according to the second embodiment of the present invention.
Figure 4:
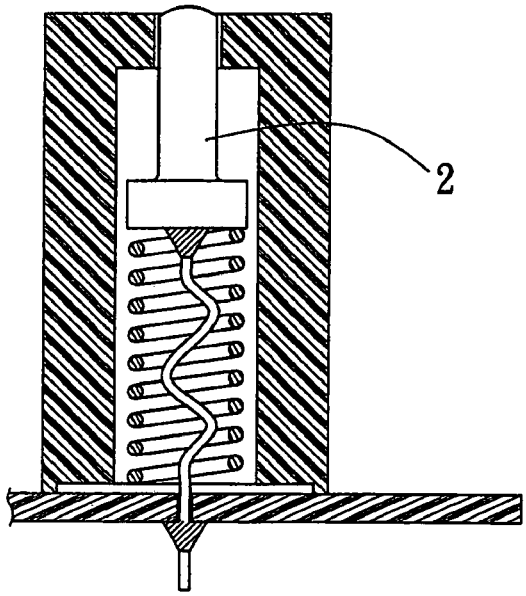
FIG. 4 is a schematic view of an electrical connector (when a first conductive body is pressed downward) according to the second embodiment of the present invention.

Referring to FIGS. 3 and 4, it discloses another embodiment. The difference between the second embodiment and the first embodiment is that in the second embodiment the conductive terminal 2 lacks a second conductive body 21. So the hook portion 200 is retained directly in the insulative housing 10. Following the same principle, the second embodiment has the same functions as the first embodiment.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An electrical connector for connecting a mating element comprising an insulative housing and a conductive terminal received in the insulative housing, wherein the conductive terminal has a first conductive body, an elastic body elastically abutted against the first conductive body, and a conductive wire electrically connected between the first conductive body and the mating element, the conductive wire being exposed outside the insulative housing for electrically connecting to the mating element.

2. The electrical connector as claimed in claim 1, wherein the first conductive body has a distal portion, and the conductive wire is connected to the distal portion.

3. The electrical connector as claimed in claim 2, wherein the distal portion is retained in the insulative housing.

4. The electrical connector as claimed in claim 1, wherein the conductive terminal further comprises a second conductive body movably connected with the first conductive body.

5. The electrical connector as claimed in claim 4, wherein the second conductive body has a receiving space for receiving the first conductive body.

6. The electrical connector as claimed in claim 4, wherein the conductive wire is electrically connected to the second conductive body.

7. The electrical connector as claimed in claim 4, wherein the conductive wire is electrically connected to the first conductive body and the second conductive body.

8. The electrical connector as claimed in claim 4, wherein the distal portion is retained in the second conductive body.

9. The electrical connector as claimed in claim 1, wherein the conductive wire is electrically connected between the first conductive body and the mating element via soldering.

* * * * *